United States Patent [19]

Stern et al.

[11] Patent Number: 4,862,117

[45] Date of Patent: Aug. 29, 1989

[54] COMPACT MILLIMETER WAVE MICROSTRIP CIRCULATOR

[75] Inventors: Richard A. Stern, Allenwood; Richard W. Babbitt, Fair Haven, both of N.J.

[73] Assignee: The United States of America as represented by the Secretary of the Army, Washington, D.C.

[21] Appl. No.: 302,509

[22] Filed: Jan. 27, 1989

[51] Int. Cl.[4] ..... H01P 1/387

[52] U.S. Cl. ..... 333/1.1; 333/24.1

[58] Field of Search ..... 333/1.1, 24.1

[56] References Cited

U.S. PATENT DOCUMENTS

| | | | |
|---|---|---|---|
| H,470 | 5/1988 | Stern | 333/1.1 |
| 4,740,762 | 4/1988 | Powers et al. | 333/1.1 |
| 4,749,966 | 6/1988 | Stern | 333/1.1 |
| 4,789,844 | 12/1988 | Schloemann | 333/1.1 |

*Primary Examiner*—Paul Gensler

*Attorney, Agent, or Firm*—Michael J. Zelenka; Robert A. Maikis

[57] ABSTRACT

A millimeter wave microstrip Y-junction circulator is provided comprising a section of microstrip dielectric substrate having a cone-shaped ferrite element mounted on one side thereof together with three, Y-junction oriented sections of microstrip conductor extending from the base of the ferrite element and an electrically conductive ground plane mounted on the other side thereof. The ferrite element is covered with a cone-shaped microstrip conductor which electrically interconnects the three Y-oriented sections of microstrip conductor. When the ferrite element is fabricated of a spinel type of ferrite, a small permanent magnet is mounted on the ground plane beneath the ferrite element to provide a unidirectional magnetic field which produces a circulator action with respect to RF energy applied to the three sections of microstrip conductor. If the ferrite element is fabricated of a hexagonal type of ferrite which produces its own internal oriented magnetic field, no external magnetic biasing means are required for the circulator.

5 Claims, 1 Drawing Sheet

FIG. 1
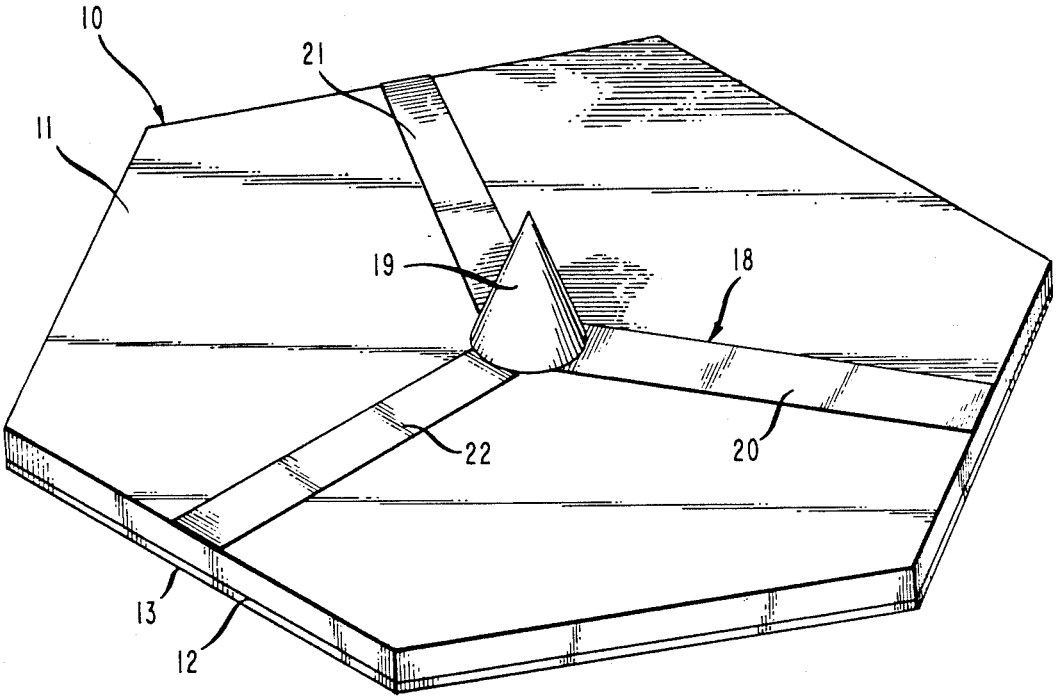
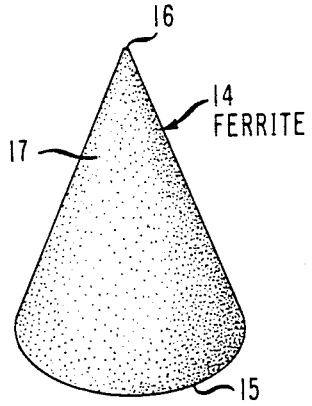
FIG. 3
FIG. 2
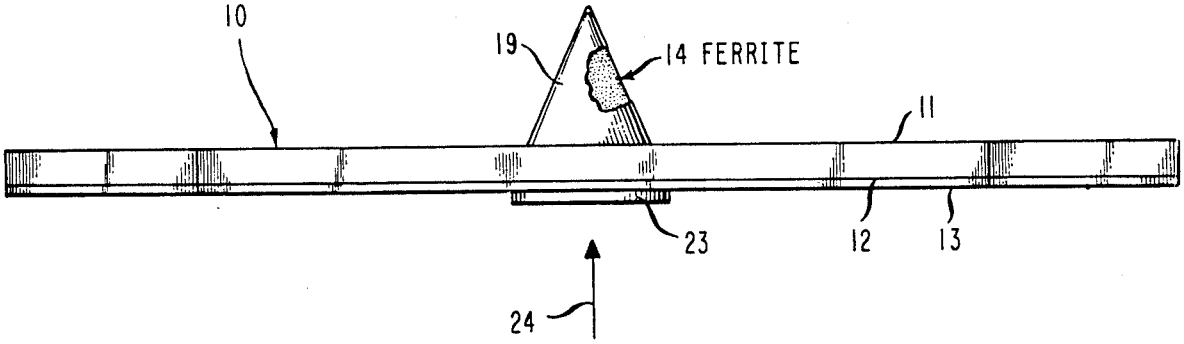

COMPACT MILLIMETER WAVE MICROSTRIP CIRCULATOR

STATEMENT OF GOVERNMENT RIGHTS

The invention described herein may be manufactured, used and licensed by or for the Government for governmental purposes without the payment to use of any royalties thereon.

BACKGROUND OF THE INVENTION

1. Field of the Invention

This invention relates to microstrip transmission lines operating in the microwave and millimeter wave regions of the frequency spectrum and more particularly to a compact microstrip Y-junction circulator for use with such microstrip transmission lines.

2. Description of the Prior Art

Y-junction circulators are non-reciprocal coupling devices having three ports which provide signal transmission from one port to an adjacent port while decoupling the signal from the remaining port. Circulators of this type are used in radar system front ends as duplexers to couple the transmitter and receiver to the single radar antenna. They are also used in many other applications, such as signal generator protection circuits and transmitter injection locking circuits, for example.

At the present time, much equipment for use in the millimeter wave region of the frequency spectrum is being designed with planar circuitry using microstrip transmission lines because of the resulting substantial reduction in the size and weight of the equipment involved. In response to a need for circuit devices, such as circulators, for example, which are suitable for use with microstrip transmission lines and other planar circuitry, the applicants of the present application developed a Y-junction microstrip circulator which is shown and described in U.S. Pat. No. 4,749,966, issued June 7, 1988 to the applicants of the present application and assigned to the same assignee as the present application. The circulator described in that patent had a Y-shaped ferrite element which was mounted on the top surface of a section of microstrip dielectric substrate having an electrically conductive ground plane mounted on the bottom surface of the substrate. The ferrite element had a central portion which was shaped as a right prism having three rectangular prism faces and top and bottom prism bases shaped as equilateral triangles. Three, downwardly-sloping arm portions extended radially outwardly from the prism faces of the ferrite element. The top surfaces of the ferrite element central portion and the three arm portions had a microstrip conductor mounted thereon so that the ferrite element could be "dropped into place" as a unit on a previously prepared top surface of the substrate having three Y-oriented lengths of microstrip conductor mounted thereon. The microstrip conductor on the ferrite element was then electrically connected to the three lengths of microstrip conductor on the substrate surface so that the three lengths of microstrip conductor acted as the ports of the circulator. A permanent magnet mounted on the ground plane beneath the ferrite element provided a magnetic biasing field in the ferrite element which produced the circulator action. Although the resulting microstrip circulator was very compact and easy to fabricate, when the ferrite element was dropped into place on the substrate surface it was necessary to radially align the three arm portions of the ferrite element with the Y-oriented lengths of microstrip conductor on the substrate surface.

SUMMARY OF THE INVENTION

It is an object of this invention to provide a microstrip circulator which is even more compact and of lower weight than the microstrip circulator shown and described in said U.S. Pat. No. 4,749,966.

It is a further object of this invention to provide a microstrip circulator of very simple configuration which is easier and less expensive to fabricate and install than the microstrip circulator shown and described in said U.S. Pat. No. 4,749,966.

It is a still further object of this invention to provide a microstrip circulator of the drop in type shown and described in said U.S. Pat. No. 4,749,966 but which does not require that the ferrite element be radially aligned with the Y-oriented microstrip conductors on the dielectric substrate surface during the fabrication and installation process.

Briefly, the microstrip Y-junction circulator of the invention comprises a microstrip dielectric substrate which has planar top and bottom surfaces and an electrically conductive ground plane mounted on the bottom surface of the substrate. A substantially cone-shaped ferrite element having a base, an apex and a substantially conical surface is mounted on the top surface of the substrate with the base of the ferrite element abutting the top surface of the substrate. Electrically conductive microstrip conductor means having a central portion and three arm portions extending radially outwardly from the central portion are provided for the circulator. The central portion of the conductor means is mounted on the substantially conical surface of the ferrite element and the arm portions are mouned on the top surface of the substrate. The arm portions of the microstrip conductor means are disposed in a Y-junction configuration with respect to each other. Finally, magnetic biasing means is provided for applying a unidirectional magnetic field between the apex and the base of the ferrite element to cause the ferrite element to act as a circulator and the arm portions of the microstrip conductor means to act as circulator ports therefor.

When the cone-shaped ferrite element is fabricated of a spinel type of ferrite, the magnetic biasing means comprises permanent magnet means mounted on the ground plane beneath the base of the ferrite element. Alternatively, when the cone-shaped ferrite element is fabricated of a hexagonal type of ferrite having a grain-oriented anisotropic magnetic field extending between the apex and the base of the ferrite element, the magnetic biasing means comprises the grain-oriented anisotropic magnetic field of the ferrite element.

The nature of the invention and other objects and additional advantages thereof will be more readily understood by those skilled in the art after consideration of the following detailed description taken in conjunction with the accompanying drawings.

BRIEF DESCRIPTION OF THE DRAWINGS

In the drawings:

FIG. 1 is a perspective view of the microstrip Y-junction circulator of the invention;

FIG. 2 is a front elevational view of the circulator of FIG. 1 with a portion of the microstrip conductor means on the ferrite element broken away for clarity of illustration; and FIG. 3 is a perspective view of the cone-shaped ferrite element which is mounted on the substrate of the circulator of FIGS. 1 and 2.

DESCRIPTION OF THE PREFERRED EMBODIMENT OF THE INVENTION

Referring now to FIGS. 1 and 2 of the drawings, there is shown a microstrip Y-junction circulator constructed in accordance with the teachings of the present invention comprising a microstrip dielectric substrate, indicated generally as 10, which has a planar top surface 11 and a planar bottom surface 12. The substrate 10 may comprise a section of conventional microstrip transmission line substrate which is usually fabricated of Duroid or other similar dielectric material having a relatively low dielectric constant. An electrically conductive ground plane 13 which should be fabricated of a good conducting metal, such as copper or silver, for example, is mounted on the bottom surface 12 of the substrate and covers that entire surface.

As seen in FIGS. 2 and 3 of the drawings, a substantially cone-shaped ferrite element, indicated generally as 14, having a base 15, an apex 16 and a substantially conical surface 17 is mounted on the top surface 11 of the substrate 10 with the base 15 of the ferrite element abutting the top surface 11 of the substrate. The ferrite element 14 should be fabricated of a ferrite material which exhibits gyromagnetic behaviour in the presence of a unidirectional magnetic field. As will be explained more fully hereinafter, the ferrite material of which the element 14 is fabricated may be either of the spinel type which requires an externally applied magnetic biasing field or a hexagonal type which supplies its own internal magnetic biasing field.

Referring again to FIG. 1 of the drawings, it is seen that the microstrip circulator of the invention also includes electrically conductive microstrip conductor means, indicated generally as 18, having a central portion 19 and three arm portions 20, 21 and 22 extending radially outwardly from the central portion 19. The central portion 19 of the microstrip conductor means 18 is mounted on the conical surface 17 of the ferrite element 14 as seen in FIG. 2 and the arm portions 20, 21 and 22 of the conductor means 18 are mounted on the top surface 11 of the substrate 10. The three arm portions 20, 21 and 22 are disposed in a Y-junction configuration with respect to each other so that each of the arm portions is disposed at an angle of 120 degrees with respect to the two remaining arm portions on the plane defined by the surface 11 of the substrate 10. Since the central portion 19 of the microstrip conductor means 18 is mounted or seated on the conical surface 17 of the cone-shaped ferrite element 14, the central portion 19 is essentially a cone-shaped microstrip conductor. The three arm portions 20, 21 and 22 of the microstrip conductor means 18 are lengths of microstrip transmission line conductor which must be electrically connected to the central portion 19 of the conductor means. The central portion 19 and the three arm portions 20, 21 and 22 should be fabricated of a good electrically conductive material, such as silver or copper, for example.

The three lengths 20, 21 and 22 of microstrip conductor together with the dielectric substrate 10 and the ground plane 13 form three separate microstrip transmission lines which serve as the ports of the circulator. When a unidirectional magnetic field is applied to the ferrite element 14 which is perpendicular to the plane of circulator coupling action, i.e., the plane defined by substrate surface 11, the ferrite element will provide a non-reciprocal coupling action between the three lengths of microstrip conductors 20, 21 and 22 because the ferrite element itself serves to couple the energy from one length of microstrip conductor to the remaining lengths. In this regard, it will be noted that although applied RF wave energy is propagated along the microstrip conductor lengths 20, 21 and 22 in the microstrip transmission line mode of wave propagation, when the applied signal reaches the ferrite element 14 it passes through the ferrite element 14 in the dielectric waveguide mode of propagation because the dielectric constant of the ferrite material is so much higher than the dielectric constant of the substrate 10. Accordingly, with a properly applied unidirectional magnetic field, the ferrite element 14, itself, will provide the nonreciprocal coupling action.

If the ferrite element 14 is fabricated of a spinel type of ferrite, such as nickel zine ferrite or lithium zinc ferrite, for example, external means are required to produce the necessary unidirectional magnetic field. As seen in FIG. 2 of the drawings, these external means may take the form of a small, cylindrical high energy permanent magnet 23 which is mounted on the ground plane 13 directly beneath the base 15 of the ferrite element 14. The cylindrical magnet 23 produces a unidirectional magnetic field which is indicated schematically by the arrow 24 and which is applied between the apex 16 and the base 15 of the ferrite element. As is well known in the art, the circular direction of circulator coupling action, i.e., clockwise or counterclockwise, may be reversed by reversing the direction of the applied unidirectional magnetic field.

Alternatively, if the ferrite element 14 is fabricated of a hexagonal type of ferrite having a grain-oriented anisotropic magnetic field which extends between the apex and the base of the ferrite element, no external magnetic biasing means are required because the magnetic biasing means is internal to the ferrite element 14 itself and comprises the grain-oriented anisotropic magnetic field of the ferrite element. Examples of hexagonal ferrite compounds are: SrM, BaM and NiCoW, where M and W represent substitutional groups well known to those skilled in the art. A specific example of a hexagonal ferrite would be barium ferrite ($Ba\ Fe_{12}\ O_{19}$). A more detailed discussion of hexagonal ferrites may be found in U.S. Statutory Invention Registration No. H470 published May 3, 1988 to the applicants of the present application and assigned to the same assignee as the present application to which reference is made for further information.

Accordingly, either a spinel type of ferrite or a hexagonal type of ferrite may be utilized to fabricate the ferrite element 14. Regardless of which type of ferrite is employed, however, it will be noted that the cone-shaped ferrite element 14 itself is substantially smaller in size, lighter in weight and easier to fabricate than the Y-shaped ferrite element utilized in the circulator shown and described in said U.S. Pat. No. 4,749,966. Furthermore, since the cone-shaped ferrite element of the present invention does not have any arms or other projections which must be radially aligned with the Y-oriented lengths of microstrip conductor on the dielectric substrate, it may be dropped into place more easily during fabrication of the microstrip circulator of the present invention. In practice, the cone-shaped element may be fabricated as a separate unit with its cone-shaped microstrip conductor thereon and then dropped into place on a previously prepared section of microstrip substrate containing the three sections of Y-oriented microstrip conductor. The three microstrip conductor lengths may then be electrically connected by means, such as soldering, for example, to the cone-shaped microstrip conductor on the cone-shaped ferrite element 14. For a relative size comparison for 35 GHz between a Y-shaped ferrite element of the type utilized in said U.S. Pat. No. 4,749,966 and the cone-shaped element of the present invention, it may be noted that the Y-shaped element would have dimensions which would circumscribe a 0.6 inch diameter circle whereas the base 15 of the cone-shaped element 14 of the present invention would have a substantially smaller 0.080 inch diameter.

It is believed apparent that many changes could be made in the construction and described uses of the foregoing microstrip Y-junction circulator and many seemingly different embodiments of the invention could be constructed without departing from the scope thereof. For example, although the apex 16 of the cone-shaped ferrite element 14 is shown as being very sharp or pointed, it could be somewhat rounded if desired. Similarly, although the circulator of the invention has been described with reference to use in the millimeter wave region of the frequency spectrum, it is apparent that the circulator is not limited in use to applications in this frequency region. Accordingly, it is intended that all matter contained in the above description or shown in the accompanying drawings shall be interpreted as illustrative and not in a limiting sense.

What is claimed is:

1. A microstrip Y-junction circulator comprising a microstrip dielectric substrate having planar top and bottom surfaces;

an electrically conductive ground plane mounted on the bottom surface of said substrate;

a substantialy cone-shaped ferrite element having a base, an apex and a substantially conical surface mounted on the top surface of said substrate with the base of said ferrite element abutting the top surface of said substrate;

electrically conductive microstrip conductor means having a central portion and three arm portions extending radially outwardly from said central portion, said central portion being mounted on said substantially conical surface of said ferrite element and said arm portions being mounted on the top surface of said substrate, said arm portions being disposed in a Y-junction configuration with respect to each other; and magnetic biasing means for applying a unidirectional magnetic field between the apex and the base of said ferrite element to cause said ferrite element to act as a circulator and said arm portions of said microstrip conductor means to act as circulator ports therefor.

2. A micostrip Y-junction circulator as claimed in claim 1 wherein said substantially cone-shaped ferrite element is shaped as a right cone.

3. A microstrip Y-junction circulator as claimed in claim 1 wherein said substantially cone-shaped ferrite element is fabricated of a spinel type of ferrite, and said magnetic biasing means comprises permanent magnet means mounted on said ground plane beneath the base of said ferrite element.

4. A microstrip Y-junction circulator as claimed in claim 1 wherein said substantially cone-shaped ferrite element is fabricated of a hexagonal type of ferrite having a grain-oriented anisotropic magnetic field which extends between the apex and the base of said ferrite element, and said magnetic biasing means comprises said grain-oriented anisotropic magnetic field of said ferrite element.

5. A microstrip Y-junction circulator as claimed in claim 1 wherein said central portion of said microstrip conductor means comprises a substantially cone-shaped microstrip conductor seated on said ferrite element, and each of said three arm portions of said microstrip conductor means comprises a length of microstrip conductor extending from and electrically connected to said substantially cone-shaped microstrip conductor.

* * * * *